US006615514B2

(12) United States Patent
Ruiz

(10) Patent No.: US 6,615,514 B2
(45) Date of Patent: Sep. 9, 2003

(54) PERFECTED LOADING MACHINE WITH EXCAVATOR SUPPLEMENT AND CHASSIS FOR THE SAME

(76) Inventor: Eloy Ayala Ruiz, Ctra. Sansón Km. 1, 2, 08980 Sant Feliu de Llobregat, Barcelona (ES)

( * ) Notice: Subject to any disclaimer, the term of this patent is extended or adjusted under 35 U.S.C. 154(b) by 0 days.

(21) Appl. No.: 09/875,160

(22) Filed: Jun. 7, 2001

(65) Prior Publication Data

US 2002/0014026 A1 Feb. 7, 2002

(30) Foreign Application Priority Data

Jun. 7, 2000 (ES) ..... 200001539
Mar. 27, 2001 (ES) ..... 200100738

(51) Int. Cl.[7] ..... E02F 3/96

(52) U.S. Cl. ..... 37/468; 32/403; 32/417; 414/686; 414/727; 296/66

(58) Field of Search ..... 37/403, 468, 404, 37/411, 412; 180/731; 296/63, 64, 66, 65.01, 68, 69; 414/686, 722, 727, 688

(56) References Cited

U.S. PATENT DOCUMENTS 3,236,394 A * 2/1966 McMullen ..... 180/331
3,297,364 A * 1/1967 McPherson ..... 299/36.1
3,466,770 A * 9/1969 Morrison et al. ..... 172/823
3,635,365 A * 1/1972 Bauer ..... 180/6.48
3,746,100 A * 7/1973 Hall et al. ..... 172/40
3,993,346 A * 11/1976 Mounts ..... 180/331
4,231,700 A * 11/1980 Studebaker ..... 37/348
4,987,689 A * 1/1991 Kaczmarski et al. ..... 37/195
5,065,967 A * 11/1991 Murakami et al. ..... 248/161
6,071,066 A * 6/2000 Braud ..... 180/297

* cited by examiner

*Primary Examiner*—Thomas B. Will
*Assistant Examiner*—Thomas A. Beach
(74) *Attorney, Agent, or Firm*—Crowell & Moring LLP

(57) ABSTRACT

A loading machine and chassis for the same, of small size, with an excavator supplement, which can be used for loading, excavation, drilling, etc. in small spaces which were previously only accessible to persons. The operator sits astride the chassis with lateral support points for the operator's feet. A hydraulic system activates the excavator supplement coupled to a loader arm mechanism. Work tools are coupleable to the excavator supplement or the loading arm mechanism.

1 Claim, 3 Drawing Sheets

PERFECTED LOADING MACHINE WITH EXCAVATOR SUPPLEMENT AND CHASSIS FOR THE SAME

BACKGROUND OF THE INVENTION

The present invention refers to a perfected loading machine and the chassis for the same. The machine is of small size, has an excavator supplement and can be used for loading, excavation, drilling, etc. in small spaces previously only accessible to persons.

Currently, for work in construction, remodelling, cleaning, transport, etc. generally related to civil works, strong and voluminous loaders are used, handled from cabins integrated into the same, which are able to carry out a large amount of work in a short time. These machines can work above ground level and also under it, as in the case of retro-excavators which have a rear articulated arm for this and are frequently used to dig ditches.

When available space is small, however, as may be the case of galleries, etc., these machines cannot reach the work area and the work must be done manually, which slows and increases the expense of the work.

Although there are small loading machines in the market able to work in very confined spaces, they still have limitations because their size cannot be further reduced due to their configuration, in which the operator is located inside a cabin forming part of the machine. There are work spaces which such machines cannot reach and where it would be a great advantage to be able to use machinery of this type. Furthermore, the smallest loaders existing in the market at this time are unable to work under the level at which they are set. This disadvantage makes them useless for the tasks of digging ditches and similar.

SUMMARY OF THE INVENTION

Because of its constitution and use, the machine of the invention is able to achieve the objective of working in extremely small spaces in an optimum manner because it has a minimal size resulting from the operator handling the same being seated astride the same instead of being in an additional space such as a cabin. This configuration reduces to a minimum the width of the machine.

The reduction in size also brings with it a reduction in weight, and these two characteristics allow the machine to be transported on light vehicles such as a four-wheel drive, van and some passenger vehicles with a large rear door, and also in lifts, etc., and is also able to work on metal beams unable to sustain other heavier machines.

Also, as a result of the attachment of an excavator supplement, the machine is able to carry out work below the level where it is set, such as ditch digging.

In accordance with the invention, the machine is comprised of a structure or chassis with apparatus to move and steer the machine, on which the operator sits astride, on a seat for this purpose, where the driver has control for handling and support points for their feet on two lateral supports. A propulsion group allows autonomous movement by the machine and supplies power to an hydraulic system that activates, at least, a loading arm and an excavator supplement for the same, with their corresponding mechanisms.

A loading arm moves on a vertical plane and is activated by a piston belonging to the hydraulic system of the machine. An end of this arm has a mechanism to which can be coupled, by rapid coupling and de-coupling, and separately, various work tools such as a front bucket, sweeper, hammer, digger, etc., or an excavator supplement. This mechanism has swing movements thanks to one or more pistons activated by the hydraulic system of the machine.

An excavator supplement in the form of an articulated forearm is coupled to the arm mechanism. This excavator supplement has its own end mechanism with swing movements owing to one or more pistons activated by the hydraulic system of the machine, on which may be coupled various work tools such as an excavator bucket, ripper, hammer, etc.

The co-operation of the swing movement of the excavator supplement, produced by the mechanism of the loader arm, and the swing movement of its own mechanism, enables the machine to carry out work of the ditch digging type at levels below that on which it is set.

The chassis is preferably built of a principal portion, noticeably laminate, of metal, curved in an inverted U-shape, and on the lower external end of each of its lateral branches has at least two points for attaching aligned wheels that give movement and/or direction to the chassis.

A support for a centered seat is provided, in a transversal direction, for the operator using the machine that the chassis of the invention forms part of, so that their legs are on both sides of the U-shaped branches, their feet resting on some lengthwise, salient lateral footrests which in turn form mudguards for the wheels.

Frontally, the U-shaped portion is closed by another laminar oblique portion, and on the upper front part of the U-shaped portion are some flanges for the swinging coupling, by an axle, of a front loading arm moved by an hydraulic piston, supported and attached to the oblique frontal portion. In the area immediately behind the coupling flanges of the arm is an area for the installation of the handling controls for the machine.

On the loading arm it is possible to couple, with an appropriate mechanism, an earth excavator supplement under the support plane of the chassis on its wheels.

The lower part of the chassis is prolonged at the rear to form a noticeably horizontal flat surface that forms a part to support and hold an internal combustion or electric engine. This platform also forms an anti-tipping support for the chassis on the ascending movement of the same on inclined land, and platform serves to support and hold the chassis during excavation operations.

DETAILED DESCRIPTION OF THE DRAWINGS

Figure 1:
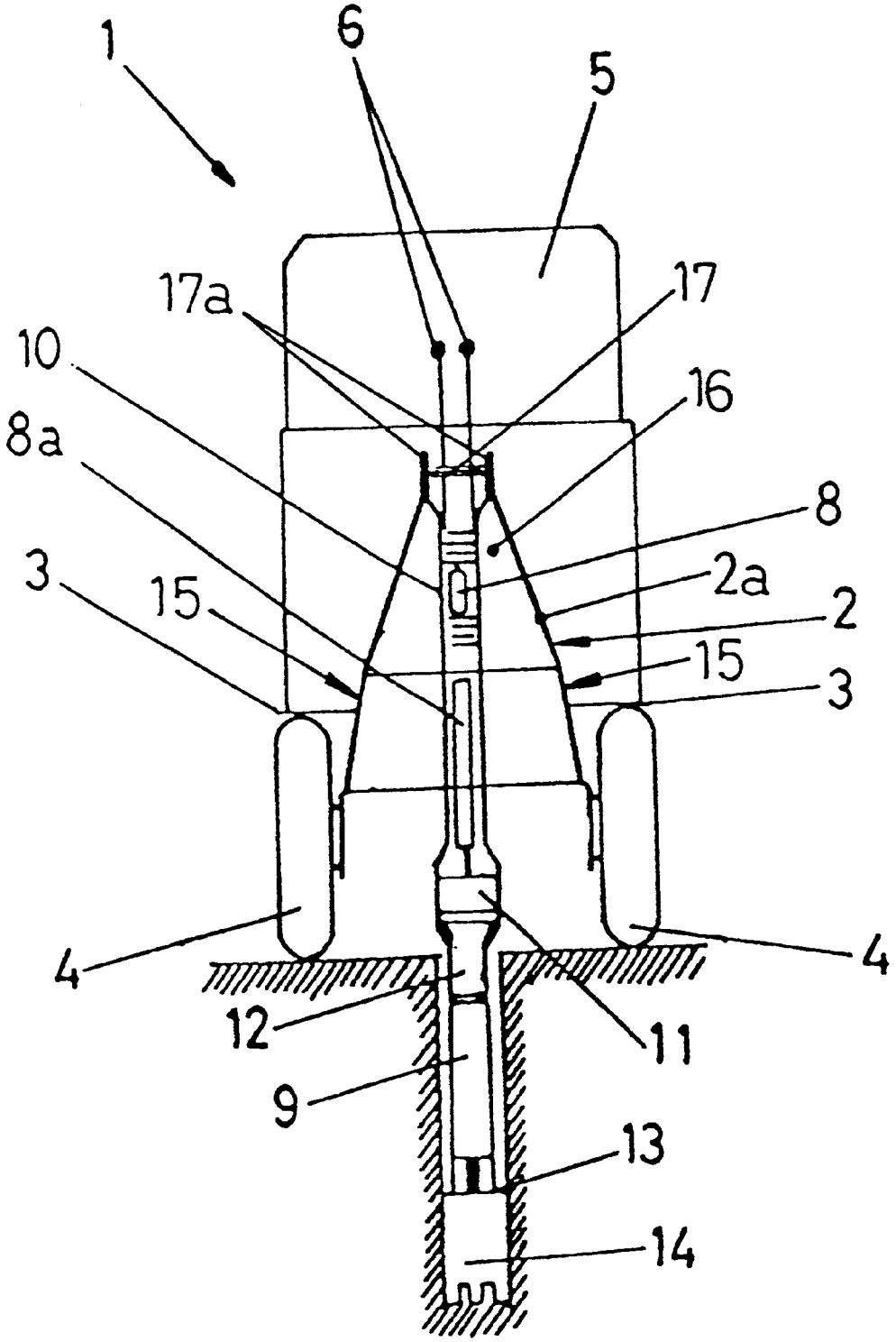
FIG. 1 is a schematic front view of the machine of the present invention.
Figure 2:
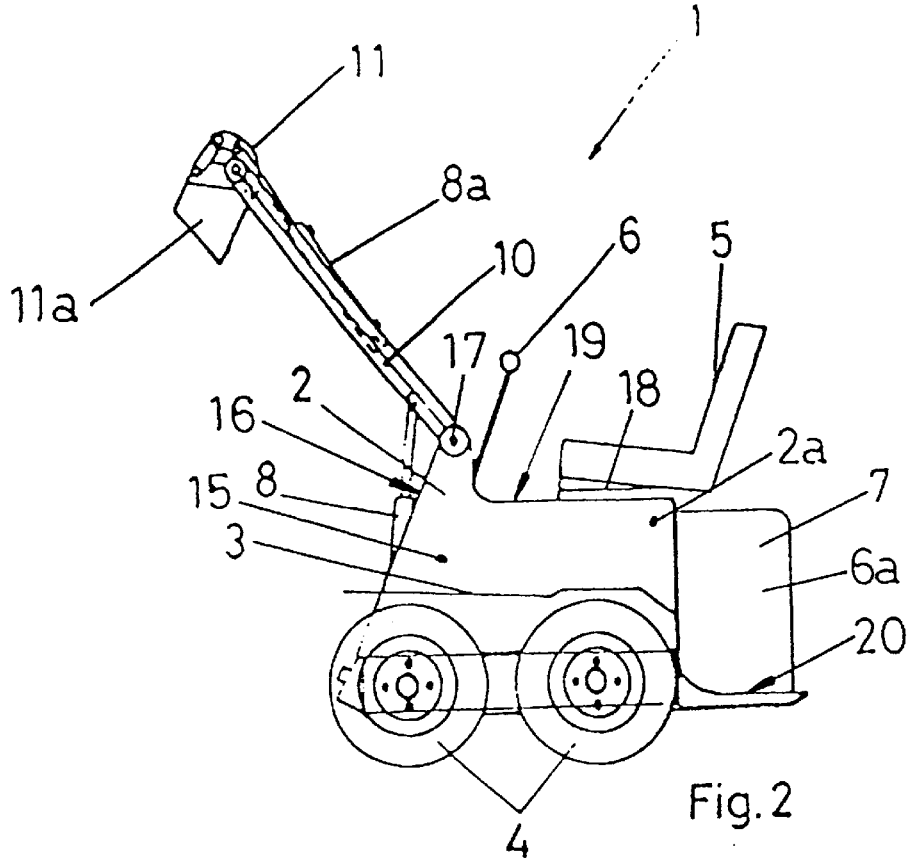
FIG. 2 is a schematic side view of the machine of the present invention with the front bucket attached.
Figure 3:
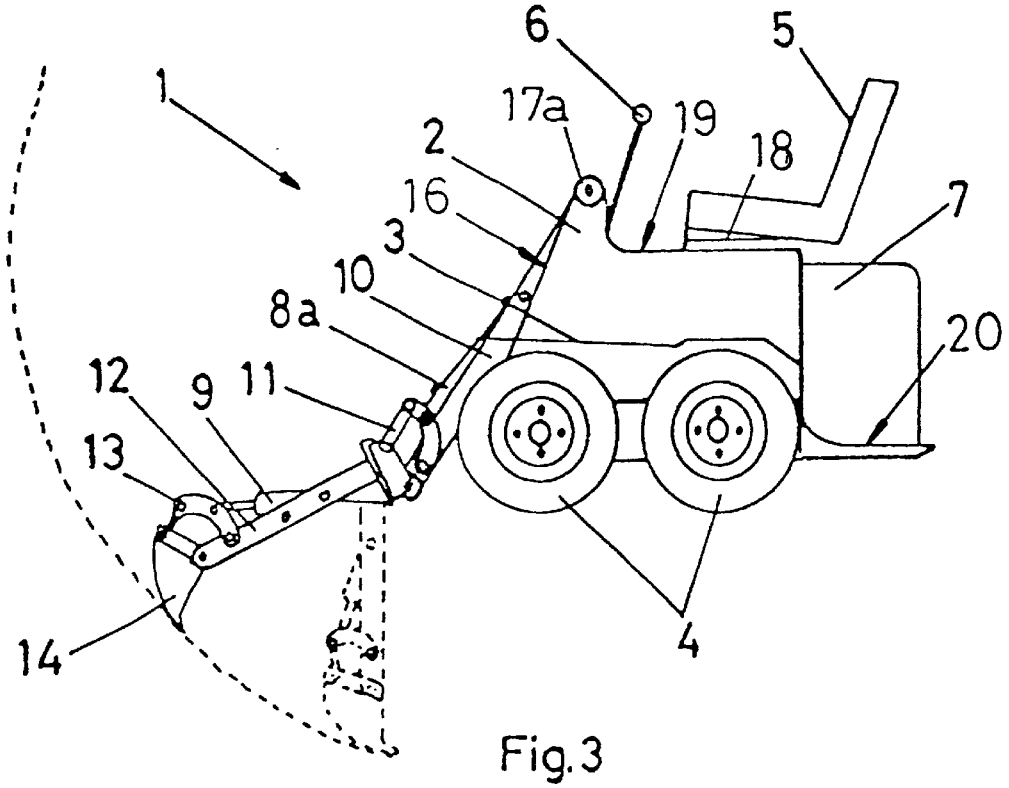
FIG. 3 is a schematic side view of the machine of the present invention with the excavator supplement and excavator bucket attached.
Figure 4:
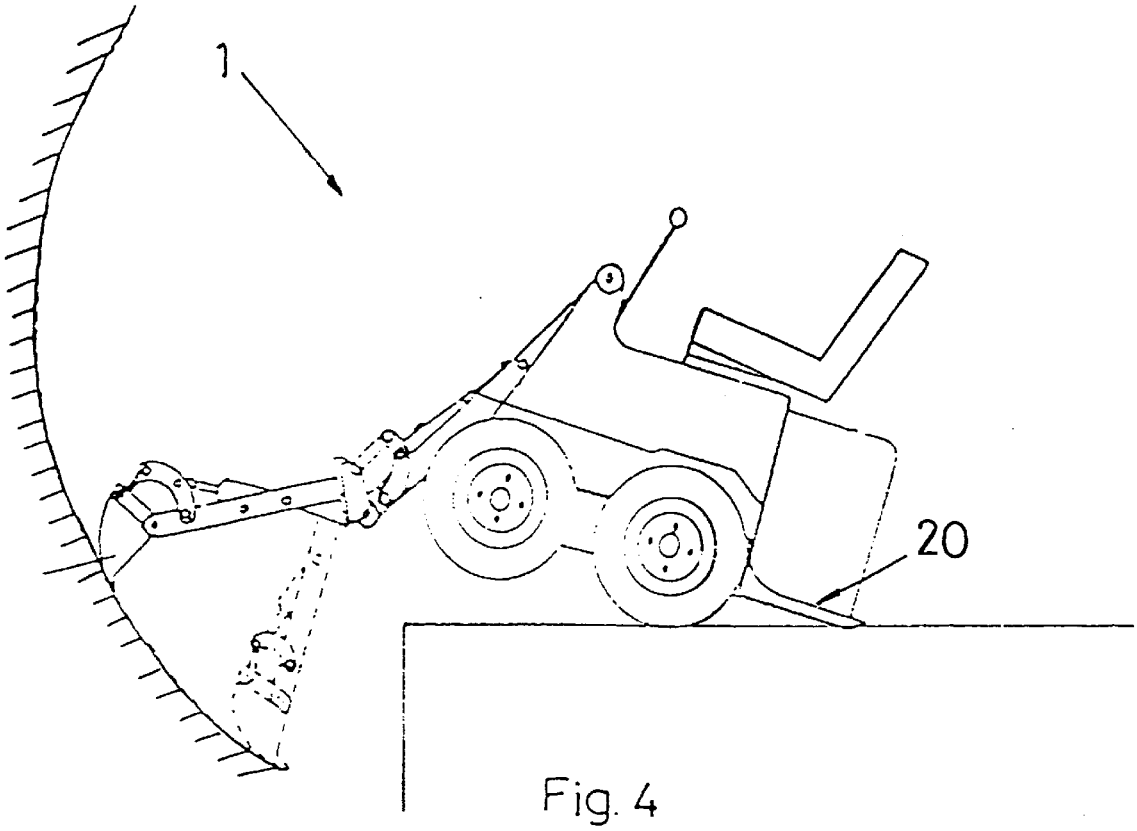
FIG. 4 is a schematic view of the support of the rear prolongation of the chassis of the present invention during excavation work.
Figure 5:
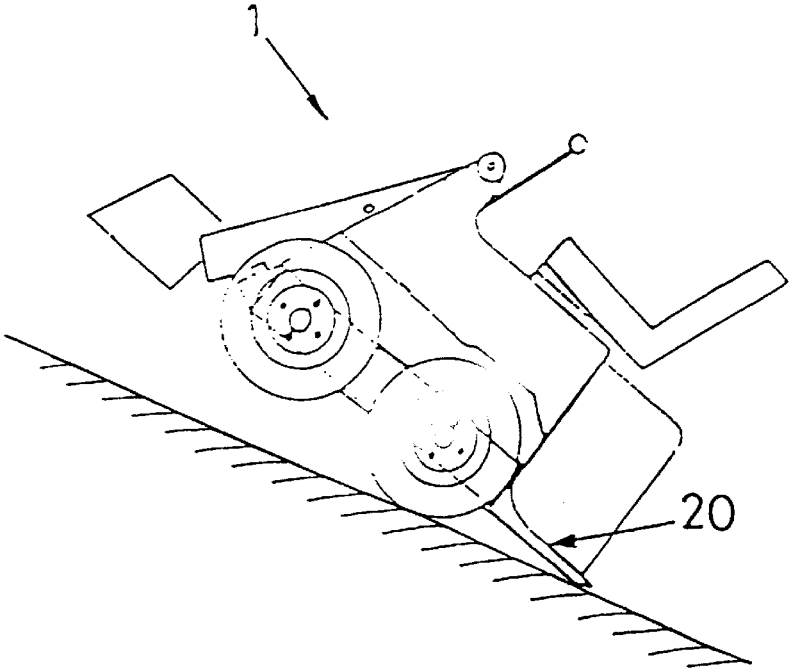
FIG. 5 is a view of the support of the rear prolongation of the chassis of the present invention ascending inclined planes.

The machine designated generally by numeral 1 of the present invention has a structure 2 on which the operator (not shown) sits astride supporting their feet on two supports 3 that form lateral running mudguards. The machine 1 has wheels 4 for movement and direction, and also a seat 5 for the operator and the working controls 6.

Hidden by the structure, a motor group 6*a* is installed to supply power to a hydraulic system 7 that moves the machine 1 and activates the pistons 8, 8*a* and 9. The piston 8 is responsible for the raising movement of a loader arm 10 on which is placed an end mechanism 11 with swing movement owing to the piston 8*a*. On this mechanism, and due to rapid coupling means, various tools can be installed separately such as a front end bucket 11*a,* or others not illustrated such as a sweeper, ditcher, etc.

The apparatus for coupling the end mechanism 11 also allows the installation of an excavator supplement 12 on the arm 10 which, taking advantage of the movements of the mechanism 11 and those of its own mechanism 13, activated by the piston 9, is able to carry out the necessary movements to excavate below the level of the seating of the machine. Work tools may be coupled to the mechanism 13 such as an excavator bucket 14, or others not illustrated such as a ripper, hammer, etc. In this way, the machine with the excavator supplement installed is able to reach points below the level of the land on which it is set, thereby allowing the excavation of ditches and other similar work.

The chassis 2 or structure has a laminar metal portion 2*a* in the form of an inverted U-shape, each of whose lateral branches 15 have two aligned wheels 4 mounted with the front part 2 of the portion 2*a* closed by another oblique portion 16 where an hydraulic piston 8 is fixed and supported to activate a loading member 10 swingingly coupled by a horizontal transverse axle 17 placed in flanges 17*a* formed by two upper frontal prolongations on the portion 2*a*.

Immediately behind the chassis flanges 17*a* is an area for the installation of the controls 6 to handle the machine 1. In a position further to the rear, a support 18 is provided for the centred transversal seat 5, so that the operator using the machine that includes this chassis puts one leg on each side of the body 19 formed by the upper central part of the inverted U-shape, resting their feet on the running footrests 3 that also form mudguards.

The lower rear part of the chassis 2 is prolonged to form a rear platform 20 that supports an internal combustion or electric engine 6*a*. The lower part of the platform 20 forms an anti-tipping support point when ascending inclined planes, and also a support and/or seating point for excavation work below the support level of the wheels, owing to the excavator supplement 12 which is coupled to the arm 10 by an appropriate end mechanism 11.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Loading machine comprising an excavator supplement, a chassis configured so that an operator sits astride the chassis, lateral support points provided for resting the operator's feet, apparatus for propulsion and movement of the loading machine arranged internally of the chassis, and a hydraulic system configured to activate at least the excavator supplement coupled to a loader arm mechanism and an end mechanism operatively arranged on the said supplement, wherein means is coupleable separately both to the loading arm mechanism and to the excavator supplement for allowing excavation work below as well as above plane of the bottom of the chassis, wherein the chassis comprises a laminar metal portion in an inverted U-shape, on a front part of which is arranged an oblique closing portion with an anchoring point for a piston to activate a front loading arm, which is swingingly coupled by an axle on some upper front flanges on the inverted-U shaped portion, and on a rear part adjacent to the flanges, an area for the installation of controls; each lateral branch of the inverted U-shaped portion has mounted on a lower end thereof two aligned wheels comprising the moving apparatus; on the back formed by a central branch of the U-shaped portion, and in a position slightly to the rear and centered, a support for a seat is arranged, with the laterally placed support points for the feet, also forming mudguards; the lower rear part of the chassis is extended rearwards to form a support and holding platform for an internal combustion or electric engine, and an anti-tipper and support during excavation operations.

* * * * *